United States Patent [19]

Honjo et al.

[11] Patent Number: 4,977,054

[45] Date of Patent: Dec. 11, 1990

[54] DEVELOPER FOR ELECTROSTATIC IMAGE COMPRISING COATED CARRIER

[75] Inventors: Toshio Honjo; Yuji Sato, both of Chiba; Yoshihiro Fukushima; Masayoshi Nawa, both of Wakayama; Shinichiro Yasuda, Osaka, all of Japan

[73] Assignees: Kao Corporation, Tokyo; Nippon Iron Powder Co. Ltd., Chiba, both of Japan

[21] Appl. No.: 375,497

[22] Filed: Jul. 5, 1989

[30] Foreign Application Priority Data

Jul. 22, 1988 [JP] Japan ..... 63-183177

[51] Int. Cl.[5] ..... G03G 9/10

[52] U.S. Cl. ..... 430/108; 430/904; 430/106.6

[58] Field of Search ..... 430/106.6, 904, 108

[56] References Cited

U.S. PATENT DOCUMENTS

| | | | |
|---|---|---|---|
| 3,996,392 | 12/1976 | Berg et al. | 430/108 |
| 4,584,254 | 4/1986 | Nakayama | 430/108 |
| 4,663,262 | 5/1981 | Oka et al. | 430/108 |

OTHER PUBLICATIONS

Abstracts, Jap. Pat. Nos. J60213963-A, 60026353-A 60007442-A, 57116349-A.

*Primary Examiner*—J. David Welsh

*Attorney, Agent, or Firm*—Birch, Stewart, Kolasch & Birch

[57] ABSTRACT

A developer for electrostatic photography comprises toner and carrier coated with a composition comprising a silicone resin having (II) and (II') and at least one compound represented by following formula (III), (IV) or (V):

(II) (III) (II') (IV) (V)

17 Claims, 1 Drawing Sheet

DEVELOPER FOR ELECTROSTATIC IMAGE COMPRISING COATED CARRIER

BACKGROUND OF THE INVENTION

1. Field of the Invention

The present invention relates to a developer for electrostatic images which is used in the formation of an image by electrophotography, more specifically to a developer for electrostatic images which is adapted to a reprographic system wherein a magnetic brush development method is adopted, and particularly to a developer of two-component type which is used in a magnetic brush development system.

2. Prior Art

In electrophotography, a uniform surface charge is given in the dark to a photosensitive member comprising a photoconductive element, which is then exposed to light to form thereon an electrostatic image, which is thereafter converted into a visible image with a developer.

Methods of developing such an electrostatic image can be broadly classified into a liquid development system and a dry development system.

The liquid development system is a method wherein development is effected with a liquid developer comprising a fine powder of one of various pigments and dyes dispersed in an insulating organic liquid, while the dry development system is a method wherein use is made of a charged colored powder, usually called a "toner," comprising a dye or a pigment, such as carbon black, contained in a natural or synthetic resin.

In the latter system, a toner is charged to a polarity reverse to that of the charge of an electrostatic image and the charged toner is electrostatically adhered to the electrostatic image to form a visible image.

The dry development system include a method wherein use is made of a so-called single-component developer comprising only the above-mentioned toner as the main component, and a method wherein use is made of a so-called two-component developer comprising a carrier such as an iron powder or glass beads mixed with the above-mentioned toner.

The former corresponds to a charged toner contact development method (see U.S. Pat. No. 2,811,465), a powder cloud method [see Photo Eng., 6 (1955)3, and the like, while the latter corresponds to a magnetic brush method (see U.S. Pat. No. 2,786,439), a cascade method (see U.S. Pat. No. 2,618,551), and the like.

A visible image formed by adhering a toner to an electrostatic image according to the aforementioned development system is then fixed either as such on a photosensitive material or after transferred to an image support such as paper.

A fixing or fixation method such as oven fixing, flash fixing, heat roller fixing, pressure fixing and heat plate fixing have been proposed and employed. The heat roller fixing has been very often employed, among them, because miniaturiazation and a good heat efficiency are available. good in heat efficiency.

Among the above-mentioned development methods, a detailed description will now be made of two-component developers in connection with the magnetic brush method, to which the present invention pertains.

Carriers which have heretofore been used in the magnetic brush development method include an reduced ore iron powder prepared by reducing an iron ore, a reduced mill scale iron powder prepared by reducing mill scales, a spherical atomized-iron powder prepared by cooling and pulverizing molten steel flowed out of fine orifices, and an iron nitride powder prepared by nitriding thin steel pieces, pulverizing resulting nitride pieces and denitriding the resulting powder. Further, use has been made of a ferrite carrier which is obtained by granulating, drying and firing a ferrite powder comprising $Fe_2O_3$ as the main starting material. Since an iron powder carrier is oxidized with moisture in the air to form $Fe_2O_3$, namely rust on the surfaces thereof, it is forcibly oxidized to cover the surfaces thereof with thin stable oxide layers having a relatively high electric resistance. The electric resistance of this carrier can be controlled according to the degree of oxidation. When an iron powder carrier is adequately controlled in shape, particle size distribution and surface resistance, a good image having a high density can be obtained.

On the other hand, a ferrite carrier is characterized in that it is 30 to 40 % lower in specific gravity than iron powder carriers, can be widely varied in electric resistance and magnetic characteristics, is spherical to be good in flowability, and can be decreased in residual magnetization. Therefore, the ferrite carrier is adapted to prolongation of the life of a developer, which, however, is not on such a level as to meet the demand. Meanwhile, a resin-coated carrier prepared by forming resin coating layers on the surfaces of core particles of an iron powder carrier, a ferrite carrier or the like was developed and has recently attracted attention because it can prevent destabilization of the charge of a toner due to sticking of the toner on the surfaces of the carrier particles, has an excellent durability, and can control the frictional chargeability of the toner and reduce the dependence of the chargeability characteristics on environment.

The requirements of the resin-coated carrier include sufficient abrasion resistance and heat resistance of the coating layers on the surfaces of the core particles, a sufficient adhesion of the coating layers to the core particles, a good sticking inhibiting property of the coating layers to prevent toner particles from sticking to the surfaces of the carrier particles, and a capability of readily giving the toner desired level and polarity of chargeability. Specifically, in a developing apparatus, the resin-coated carrier particles undergo friction onto only with each other but also with toner particles and the wall of the apparatus. If the coating layers are abraded by such friction, the charging to be brought about by friction thereof with the toner is destabilized. Further, when the adhesion of the coating layers to the core particles is insufficient, the coating layers are separated from the core particles by the above-mentioned friction to lose the stable frictional chargeability. Furthermore, when the toner sticks to the resin-coated carrier, the frictional chargeability of the toner is spoiled.

Although various resin-coated carriers have heretofore been developed, none of them can fully satisfy the aforementioned requirements. For example, when a common resin is used as a material of coating layers, it is liable to cause sticking of a toner because of the high surface energy thereof. As a countermeasure thereagainst, it is conceivable to use a fluororesin having a low surface energy. Since, however, fluororesins are poor in adhesion and insoluble in almost all solvents and involve complicated coating and heat treatment methods, they are judged to be inadequate as coating materials for core particles.

Silicone resins can be mentioned as other resins having a low surface energy. Although they have advantages of water repellency and high resistance in addition to the low surface energy, they have a disadvantage of such poor adhesion that they are apt to cause separation when used in coating layers.

In order to overcome this disadvantage, there have been proposed various methods such as use of a resin-modified silicone resin (see Japanese Patent Laid-Open No. 127,569/1980), incorporation of a vinylsilane to be reacted with other resin (see Japanese Patent Laid-Open No. 32,149/1981), use of a mixture of a trialkoxysilane with ethylcellulose (see U.S. Pat. No. 3,840,464), and use of a mixture of an organosilicone terpolymer with a polyphenylene resin (see U.S. Pat. No. 3,849,127). However, these methods involve problems such as the necessity of a temperature as high as 300° C. or above for formation of coating layers and/or the poor compatibility of a silicone resin with other resin which results in formation of non-uniform coating layers to fail to provide expected characteristics. Further, formation of coating layers at a comparatively low curing temperature has been proposed (see Japanese Patent Laid-Open No. 127,569/1980), but it provides insufficient adhesion and toughness of the coating layers, which is, therefore, liable to be readily abraded, leading to a poor printing resistance.

As for the prolongation of the life of a developer, investigations must be made with consideration being given to the performances of core particles and a toner. Specifically, where a ferrite carrier is used as core particles, the ratio and homogeneity of a composition composed of raw materials of ferrite, such as $Fe_2O_3$, NiO, CuO, CoO, MgO, ZnO, $MnCO_3$, $BaCO_3$, $SrCO_3$, $Li_2(CO_3)$ and CdO, are important, and materials little liable to undergo any chemical change must be selected.

Meanwhile, a toner, which is generally prepared by kneading a thermoplastic resin and a dye or pigment as the main components, pulverizing the kneaded mass, and classifying the resulting powder to provide an optimum particle size distribution, is mixed with a carrier to be ready for use. The characteristics of the resulting developer largely depend on the performance of the resin used. Where use is made of a resin having a low softening point and hence a low molecular weight, the resulting toner is so liable to stick to the carrier and so readily crushable that not only the life of the resulting developer is conspicuously shortened but also the toner fuses and adheres to a heat roller in the case of heat roller fixing to cause hot offsetting to thereby notably deteriorate an image. However, a mere increase in the molecular weight makes a resin tough to lower the fixability of a toner on supports such as paper to deteriorate the overall performance thereof, though it may prolong the life of a developer.

An object of the present invention is to solve the above-mentioned problems of the prior art to thereby provide a developer for electrostatic images which has a sufficient durability, a stable frictional chargeability and a markedly long life.

Another object of the present invention is to provide a developer for electrostatic images which is excellent in flowability and free of the dependence on environment.

Still another object of the present invention is to provide a developer for electrostatic images which is excellent in fixabilty on supports such as paper and resistance to offset onto a roller.

A further object of the present invention is to provide a developer for electrostatic images which enables high-quality image printing and duplication with a good resolution, a good tone reproduction and a low background density.

SUMMARY OF THE INVENTION

As a result of intensive investigations with a view to solving the above-mentioned problems, the inventors of the present invention have completed the present invention.

Specifically, the present invention provides a developer for electrostatic images comprising a toner and a carrier, characterized in that the carrier is made of a magnetic powder having a composition represented by the following formula (I) and has surfaces coated with a resin composition comprising a silicone resin in the form of a combination of segments represented by the following general formula (II) and segments represented by the following general formula (II') and at least one member selected from the group consisting of compounds represented by the following general formula (III), (IV) or (V):

$$(MO)_x(Fe_wO_3)_y \qquad \text{(I)}$$

(wherein M stands for at least one metal selected from the group consisting of Li, Mg, Mn, Fe(II), Co, Ni, Cu, Zn, Cd, Sr, and Ba; and the molar ratio of x to y is at most 1.0, preferably at least 0.30);

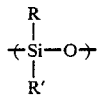

(II)

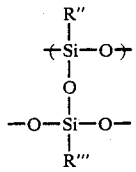

(II')

(wherein R, R', R'' and R''' each stand for a hydrogen atom, a halogen atom, a hydroxyl group, a methoxy group, a lower alkyl group having 1 to 4 carbon atoms, or a phenyl group);

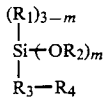

(III)

(wherein m is 2 or 3, $R_1$ and $R_2$ are each an alkyl group having 1 to 3 carbon atoms, $R_3$ is an alkylene group having 1 to 8 carbon atoms, and $R_4$ is a glycidoxy group or an epoxycyclohexyl group);

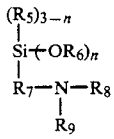

(IV)

(wherein n is 2 or 3; $R_5$ and $R_6$ are each an alkyl group having 1 to 3 carbon atoms; $R_7$ is an alkylene group having 1 to 3 carbon atoms; $R_8$ and $R_9$ are each a hydrogen atom, a methyl group, an ethyl group, a phenyl group, an aminomethyl group, or an aminoethyl group); and

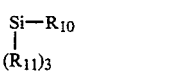

(V)

(wherein $R_{10}$ is an alkyl group having 1 to 3 carbon atoms or a vinyl group; and $R_{11}$ is a substituent selected from among $R_{12}COO$—, $R_{12}$—NH—, $R_{12}$—0—,

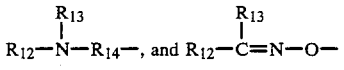

wherein $R_{12}$ and $R_{13}$ are each an alkyl group having 1 to 3 carbon atoms, and $R_{14}$ is an alkylene group having 1 to 3 carbon atoms).

Core particles usable in the present invention are a ferrite prepared from not only $Fe_2O_3$ but also other raw materials such as NiO, CuO, MgO, ZnO, $MnCO_3$, $BaCO_3$, $SrCO_3$, $Li_2(CO_3)$ and CdO, and optionally other usable additives such as $SiO_2$, $CaCO_3$, $TiO_2$, $SnO_2$, PbO, $V_2O_5$, $Bi_2O_3$ or $Al_2O_3$.

A binder such as polyvinyl alcohol, an anti-foaming agent, a dispersant, etc. are added to a starting material, prepared by blending several kinds of metallic oxides as main raw materials optionally together with other metallic oxides as additives, drying the blend, and firing the dried blend, to prepare a slurry for granulation. The slurry is spray-dried to prepare granules, which are then fired in an electric furnace at 900 to 1,400° C., crushed and classified to produce core particles.

While the term "ferrite carrier" generally refers to one containing at least 40 mol % of $Fe_2O_3$, ferrite core particles usable in the present invention are those containing at least 50 mol % of $Fe_2O_3$ from the viewpoint of the stability thereof in magnetic characteristics. The combined use of NiO or CuO with ZnO as adjuvant materials provides core particles favorable for the prolongation of the service life. ZnO is used to provide a low saturation magnetization. Since the use of too much ZnO lowers the Curie temperature, however, NiO or CuO effective in providing a low saturation magnetization though not comparable to ZnO is combined therewith. More specifically, the amount of ZnO is at most 40 mol % and the total amount of ZnO and NiO or CuO is at most 50 mol %. When x/y exceeds 1.00, namely the amount of $Fe_2O_3$ is smaller than 50 mol %, the resistance of a carrier is increased not only to tend to cause fogging of images even if the carrier is coated with a resin, but also to provide too high an edge effect. When x/y is less than 0.30, namely the amount of $Fe_2O_3$ exceeds 77 mol %, the saturation magnetization is lowered to tend to cause scattering of a carrier.

A saturation magnetization of 35 emu/g or lower is liable to cause scattering of a carrier, while a saturation magnetization exceeding 85 emu/g acts to harden the bristles of a magnetic brush to lower the density of images. A resistivity of $10^8$ Ωcm or lower acts to lower the resolution and deteriorate the gradation with a liability to cause a ready change in the image density according to changes in the environment, while a resistivity of $10^5$ Ωcm or higher acts to lower the image density, deteriorate the environmental resistance and cause scattering of a carrier.

The above-mentioned effects are all unfavorable and hence desired to be avoided if possible.

The silicone resin in the resin composition for coating the surfaces of the carrier according to the present invention is most suitably one having a low surface tension which is in the form of a combination of segments represented by the aforementioned general formula (II) and segments represented by the aforementioned general formula (II'). Among others, those having methyl groups as all of R, R', R'' and R''' are most preferable from the viewpoint of adhesion and toughness, but may be partially modified with phenyl or ethyl groups to control the flowability, smoothness and chargeability.

The use of a modified silicone resin has also been proposed in order to improve the adhesion thereof. Examples of such a modified silicone resin include alkyd-, epoxy-, acryl-, polyester-, phenol-, melamine-, and urethane-modified ones, which are, however, unfavorable because of the increased surface energies thereof with a liability to cause sticking of a toner and spoil the durability of a developer.

In view of the above, according to the present invention, the above-mentioned silicone resin is admixed with at least one silicon compound represented by the aforementioned general formula (III), (IV) or (V), particularly preferably at least two such silicon compounds, in an amount of preferably 0.1 to 7 wt.%, more preferably at least 0.5 wt.%, to improve the adhesion of coating layers to core particles and hence suppress separation of the coating layers therefrom to thereby stabilize the amount of charge of a toner and prolong the service life of a developer.

In the aforementioned formula (V); $R_{11}$ is preferably $R_{12}COO$— or

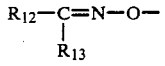

from the viewpoint of stability on the level of the amount of charge, and adhesion and toughness of coating layers.

Specific examples of the compound represented by the aforementioned formula (III) include compounds of the following formulae [III-1] to [III-3].

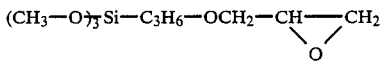

[III-1]

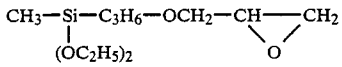

[III-2]

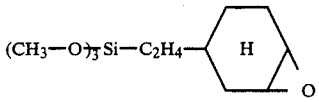

[III]

Specific examples of the compound represented by the aforementioned formula (IV) include compounds of the following formulae [IV-1] to [IV-4].

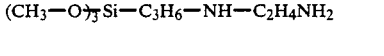

[IV-1]

-continued

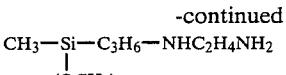

[IV-2]

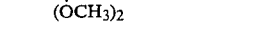

[IV-3]

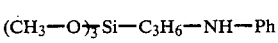

[IV-4]

Specific examples of the compound represented by the aforementioned formula (V) includes compounds of the following formulae [V-1] to [V-6].

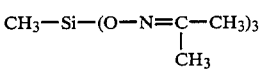

[V-1]

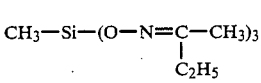

[V-2]

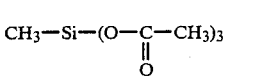

[V-3]

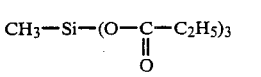

[V-4]

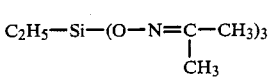

[V-5]

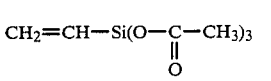

[V-6]

In the present invention, the aforementioned silicone resin coating composition is preferably used in an amount of 0.5 to 10 wt.% based on the carrier to coat therewith the carrier.

Meanwhile, in general, a toner, which is prepared by kneading a thermoplastic resin and a dye or pigment as the main components, pulverizing the kneaded mass and classifying the resulting powder to provide an optimum particle size distribution, is mixed with a carrier to be ready for use. The characteristics of the resulting developer largely depend on the characteristics of the toner, and hence largely depend on the performance of the binder resin, the content of which is high in the toner. For example, where use is made of a binder resin having a low softening point and hence a low molecular weight, a so-called spent toner sticking to the carrier is generated and a toner is easily crushable to often shorten the life of the developer. However, mere rises in the softening point and molecular weight of a binder resin make the resin tough to deteriorate the fixability of a toner on supports such as paper and hence lower the overall performance of a developer, though they may serve to avoid generation of a spent toner and crushing of a toner.

Resins usable in toners include styrene, epoxy, polypropylene, vinyl ester, polyethylene, and polyester resins, among which specific polyester and styrene resins are preferred as a main component of the toner in the present invention.

Polyester resins are preferred since they have a high cohesive energy and contain carboxyl groups to provide a good fixability. In order to secure a shelf stability of a toner, it is more preferable to use a polyester resin having main constituent units of a polybasic carboxylic acid, or an anhydride or an ester thereof represented by the following general formula (VI) and a diol represented by the following general formula (VII).

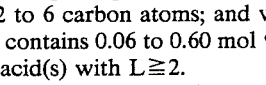

(VI)

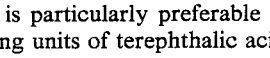

(VII)

wherein $L \geqq 1$, R is a benzene ring, R is a hydrogen atom or a lower alkyl group, R is a bivalent group containing a bisphenol group or an alkylene group having 2 to 6 carbon atoms; and wherein the acid component contains 0.06 to 0.60 mol % of a polybasic carboxylic acid(s) with $L \geqq 2$.

It is particularly preferable to use a polyester resin having units of terephthalic acid or a lower alkyl ester thereof as a main component of the at least dibasic carboxylic acid(s). Incorporation of an adequate amount of an at least tribasic carboxylic acid such as trimellitic acid or anhydride or a lower alkyl ester thereof into the acid component may serve to secure both a fixability and a hot offset resistance. When the amount is too small, such effects cannot be secured. When it is too large, the acid value is so high that the chargeability may be lowered or the crosslinkage density may be too high. Thus, the content of such an at least tribasic carboxylic acid in the acid component is preferably 0.06 to 0.6 mol %.

Examples of the diol represented by the aforementioned formula (VII) include polyoxypropylene bisphenol A, polyoxyethylene bisphenol A, ethylene glycol, propylene glycol, 1,6-hexanediol, and 1,4-butanediol.

The softening point of a polyester resin to be used is preferably 120 to 180° C as measured with a Koka type flow tester. When the softening point is lower than 120° C. as measured with the Koka type flow tester, hot offsetting is liable to occur when use is made of a hot roller, which must, therefore, be coated with a silicone oil as a countermeasure thereagainst, though the fixability can be secured. In this case, the service life span of a developer also tends to be shortened. When the softening point exceeds 180° C., there arises a notable tendency toward deterioration of the fixability, which can, however, be improved by incorporation of at least one of the following monomers capable of providing a flexibility. Of course, these monomers are also applicable to a polyester resin having a softening point lower than 180° C. to improve the fixability thereof.

The monomers capable of providing a flexibility are the following diols and dicarboxylic acids.

Diols:

ethylene glycol, diethylene glycol, propylene glycol, dipropylene glycol, 1,6-hexanediol, 1,4-butanediol, etc.

Dicarboxylic acids:

fumaric acid, succinic acid derivatives containing an alkyl or alkenyl group having 4 to 12 carbon atoms, succinic acid, adipic acid, anhydrides and lower alkyl esters thereof, etc.

The polyester resin that may be used in the present invention can be prepared by polycondensation of the polybasic carboxylic acid component with the polyol component in an atmosphere of an inert gas at a temperature of 180° to 250° C, in which use may be made of an esterification catalyst as commonly used for the purpose of promoting the reaction, such as zinc oxide, stannous oxide, dibutyltin oxide, or dibutyltin dilaurate. Further, a reduced pressure may be adopted in the preparation for the same purpose.

On the other hand, styrene resins that may be used in the present invention include preferably, a copolymer of a styrene with other vinyl monomer in view of the fact that it is difficult to obtain a styrene homopolymer resin having an optimum softening point and a preferable molecular weight distribution because a styrene homopolymer is brittle in the case of a low molecular weight one and is too high in softening point, though tough, in the case of a high molecular weight one.

Examples of the other vinyl monomer include ethylenically unsaturated monoolefins such as ethylene, propylene, and isobutylene; vinyl halides such as vinyl chloride, vinyl bromide, and vinyl fluoride; vinyl esters such as vinyl acetate; acrylic and methacrylic esters such as n-butyl acrylate, 2-ethylhexyl acrylate, 2-ethylhexyl methacrylate, and dodecyl methacrylate; vinyl ethers such as vinyl methyl ether and vinyl ethyl ether; vinyl ketones such as vinyl methyl ketone and vinyl hexyl ketone; acrylonitrile; methacrylonitrile; acrylamide; and butadiene. Among them, alkyl (having 4 to 18 carbon atoms) esters of acrylic and methacrylic acid, and butadiene are preferred since they are highly copolymerizable with a styrene and capable of providing such a flexibility as to improve a polystyrene in rigidness and brittleness.

Particularly preferred styrene copolymers are those having main constituent units of a styrene represented by the following formula (VIII) and an acrylic or methacrylic ester represented by the following general formula (IX).

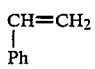

(VIII)

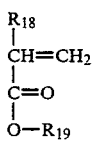

(IX)

wherein Ph is a phenyl group, $R_{18}$ is a hydrogen atom or a methyl group, and $R_{19}$ is an alkyl group having 4 to 18 carbon atoms, preferably 4 to 8 carbon atoms.

When the above-mentioned alkyl group represented by $R_{19}$ has 3 or less carbon atoms, the corresponding segments are unfavorably rigid. If it has more than 18 carbon atoms, crystallization of side chains occurs unfavorably.

The styrene copolymer preferably has a number-average molecular weight of at least 5,000, a molecular weight distribution width of at least 10, and a softening point of at most 180° C. as measured with the Koka type flow tester.

When the number-average molecular weight is lower than 5,000, hot offsetting is liable to occur, thus requiring a countermeasure thereagainst wherein a roller is coated with a silicone oil. When the molecular weight distribution width exceeds 10 and the softening point is lower than 180° C. as measured with the Koka type flow tester, advantageous improvements are attained in the service life of a developer, the fixability of a toner and the hot offsetting resistance thereof.

The styrene resin that may be used in the present invention is prepared under a combination of known conditions for addition polymerization reactions. Such preparation conditions can be determined by adequate choice through experiments by any person skilled in the art.

The preparation conditions will now be described. With consideration being given to the target softening point of a binder resin, the reaction temperature and time which can be determined on the basis of the kind and half-life period of a polymerization initiator are used as factors to determine the concentration of the polymerization initiator and the polymerization temperature. Radical polymerization is particularly preferably employed in the present invention. In this case, known chain transfer agent and crosslinking agent may be added to the reaction system if desired.

The softening point of a binder resin is determined with a flow tester, named by "Koka-shiki" being available from Shimazu Seisakusho, a Japanese corporation, in the following manner. As shown in FIG. 1, a load of 20 kg/cm2 from the plunger 2 of the flow tester is applied onto 1 cm3 of a sample 1 heated at a temperature elevation rate of 6° C./min to extrude the sample through a nozzle 3 having a diameter of 1 mm and a length of 1 mm, while preparing a plunger fall distance (amount of flow)—temperature curve with respect to the flow tester as shown in FIG. 2, from which a temperature corresponding to h/2, wherein h is the height of the S curve, is found to be defined as the softening temperature.

Examples of a coloring agent to be used together with the binder resin in the present invention to form a toner include carbon black, phthalocyanine blue, Rhodamine B Base, Nigrosine dyes, chrome yellow, lamp black, oil black, and mixtures thereof. The coloring agent is usually used in an amount of 1 to 15 parts by weight per 100 parts by weight of the binder resin. Carbon black is a particularly preferable coloring agent.

In order to control the chargeability of the toner, use may be made of a known charge control agent, examples of which include metal complexes mentioned in Japanese Patent Publication Nos. 20,153/ 1966, 17,955/1968 and 2,647/1970, and Japanese Patent Laid-Open No. 120,765/1981.

The developer of the invention is improved in durability, fixability, offset latitude and environmental stability and then provides a developed image with a high quality.

Figure 1:
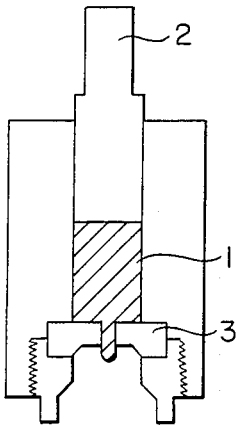
FIG. 1 is a cross-sectional view of the flow tester.
Figure 2:
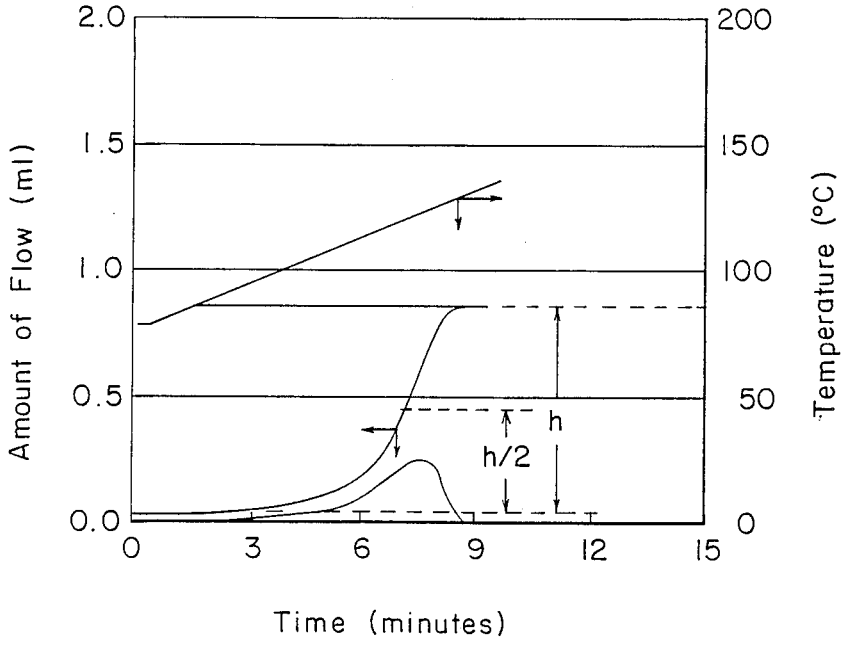
FIG. 2 is a plunger-fall distance (amount of flow) - temperature curve with respect to the flow tester.

1: sample
2: plunger
3: nozzle

EXAMPLES

A description will now be made of Preparation Examples of carriers (core particles), coated carriers and binder resins, and Examples of the present invention, to which the present invention, however, is not limited.

Carrier Preparation Example 1

20 mol % of $NiCO_3$, 25 mol % of ZnO, and 55 mol % of $Fe_2O_3$ were pulverized and mixed with one another with a wet ball mill for 10 hours, dried, and kept at 950° C. for 4 hours. The resulting mixture was further pulverized to a size of at most 5 μm with a wet ball mill for 24 hours. The resulting slurry was granulated, dried, kept at 1,400° C. for 6 hours, further pulverized, and classified to a size of 60 to 100 μm.

The component analysis of the resulting granulated carrier revealed that it contained 21mole of NiO 24 mol % of ZnO, and 55 mol % of $Fe_2O_3$ with a molar ratio x/y of 0.82.

The magnetic measurement on the carrier showed a magnetization value of 80 emu/g at 3,000 Öe, a coercive force of 0, and a residual magnetization of 0. The apparent density of the carrier was 2.7 g/cm$^3$.

Carrier Preparation Example 2

15 mol % of CuO, 32 mol % of ZnO, and 53 mol % of $Fe_2O_3$ were pulverized and mixed with one another with a wet ball mill for 10 hours, dried, and kept at 950° C. for 4 hours. The resulting mixture was further pulverized to a size of at most 5 μm with a wet ball mill for 24 hours. The resulting slurry was granulated, dried, kept at 1,140° C. for 6 hours, further pulverized, and classified to a size of 75 to 150 μm.

The resulting granulated carrier had a composition composed of 15.5 mol % of CuO, 30 mol % of ZnO and 54.5 mol % of $Fe_2O_3$ The molar ratio x/y was 0.83.

The magnetization value, coercive force, and residual magnetization of the carrier were 50 emu/g at 3,000 Öe, 0, and 0, respectively. The apparent density of the carrier was 2.8 g/cm$^3$.

Carrier Preparation Example 3

A granulated carrier of 75 to 150 μm in size was prepared from 15 mol % of CuO, 16 mol % of ZnO, and 69 mol % of $Fe_2O_3$ in substantially the same manner as that of Carrier Preparation Example 2.

The granulated carrier had a composition composed of 15.5 mol % of CuO, 14.5 mol % of ZnO and 70 mol % of $Fe_2O_3$. The molar ratio x/y was 0.43.

The magnetization value of the carrier was 42 emu/g at 3,000 Öe, while the apparent density thereof was 2.7 g/cm$^3$.

Carrier Preparation Example 4

A granulated carrier of 70 to 200 μm in size was prepared from 15 mol % of $NiCO_3$, 20 mol % of ZnO and 65 mol % of $Fe_2O_3$ in substantially the same manner as that of Carrier Preparation Example 1. It had a composition composed of 15.5 mol % of NiO, 19 mol % of ZnO, and 65.5 mol % of $Fe_2O_3$. The molar ratio x/y was 0.53.

The magnetization value, coercive force, and residual magnetization of the carrier were 75 emu/g at 3,000 Öe, 0, and 0, respectively. The apparent density of the carrier was 2.6 g/cm$^3$.

Resin-Coated Carrier Preparation Example 1

100 parts by weight of a silicone resin in the form of a combination comprising two kinds of segments represented by the formulae:

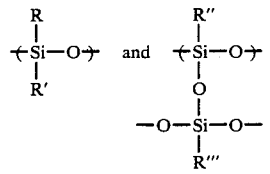

wherein R, R′, R″ and R‴ are all methyl groups was admixed with 3 parts by weight each of the aforementioned compounds III-1 and V-6 to prepare a coating resin composition.

Using a fluidized bed, the carrier prepared in Carrier Preparation Example 1 was coated with 5 wt.%, based on the carrier, of the above-mentioned coating resin composition, which was then baked at 190° C. for 3 hours to prepare a resin-coated carrier (C-1).

The apparent density, resistance, and saturation magnetization of the resin-coated carrier (C-1) were 2.55 g/cm$^3$, $10^{14}$ Ωcm, and 76 emu/g, respectively.

Resin-Coated Carrier Preparation Example 2

100 parts by weight of the same silicone resin as that shown in Resin-Coated Carrier Preparation Example 1 was admixed with 2 parts by weight of the aforementioned compound III-1 and 5 parts by weight of the aforementioned compound IV-4 to prepare a coating resin composition.

Using a fluidized bed, the carrier prepared in Carrier Preparation Example 2 was coated with 2 wt.%, based on the carrier, of the above-mentioned coating resin composition, which was then baked at 190° C. for 3 hours to prepare a resin-coated carrier (C-2).

The apparent density, resistance, and saturation magnetization of the resin-coated carrier (C-2) were 2.73 g/cm$^3$, $10^{13}$ Ωcm, and 49 emu/g, respectively.

Resin-Coated Carrier Preparation Example 3

100 parts by weight of the same silicone resin as that shown in Resin-Coated Carrier Preparation Example 1 was admixed with 3 parts by weight of the aforementioned compound III-1 to prepare a coating resin composition.

Using a fluidized bed, the carrier prepared in Carrier Preparation Example 3 was coated with 0.5 wt.%, based on the carrier, of the above-mentioned coating resin composition, which was then baked at 190° C. for 3 hours to prepare a resin-coated carrier (C-3).

The apparent density, resistance, and saturation magnetization of the resin-coated carrier (C-3) were 2.62 g/cm$^3$, $10^9$ Ωcm, and 41 emu/g, respectively.

Resin-Coated Carrier Preparation Example 4

100 parts by weight of a resin prepared by substituting phenyl groups for about 10% of methyl groups of the same silicone resin as that shown in Resin-Coated Carrier Preparation Example 1 was admixed with 2 parts by weight each of the aforementioned compounds III-1 and V-6 to prepare a coating resin composition.

Using a fluidized bed, the carrier prepared in Carrier Preparation Example 1 was coated with 5 wt.%, based on the carrier, of the abovementioned coating resin composition, which was then baked at 296° C. for 3 hours to prepare a resin-coated carrier (C-4).

The apparent density, resistance, and saturation magnetization of the resin-coated carrier (C-4) were 2.52 g/cm$^3$, $10^{14}$ Ωcm, and 76 emu/g, respectively.

Resin-Coated Carrier Preparation Example 5

100 parts by weight of the same silicone resin as that used in Resin-Coated Carrier Preparation Example 4 was admixed with 1 part by weight each of the aforementioned compounds IV-1 and V-5 to prepare a coating resin composition.

Using a fluidized bed, the carrier prepared in Carrier Preparation Example 2 was coated with 5 wt.%, based on the carrier, of the above-mentioned coating resin composition, which was then baked at 190° C. for 3 hours to prepare a resin-coated carrier (C-5).

The apparent density, resistance, and saturation magnetization of the resin-coated carrier (C-5) were 2.65 g/cm$^3$, $10^{15}$ Ωcm, and 47 emu/g, respectively.

Comparative Resin-Coated Carrier Preparation Example 1

Using a fluidized bed, the carrier prepared in Carrier Preparation Example 1 was coated with 5 wt.%, based on the carrier, of an alkyd resin-modified silicone resin (KR-201, manufactured by The Shin-Etsu Chemical Co., Ltd.), which was then baked at 150° C. for 3 hours to prepare a resin-coated carrier (C-6).

The apparent density, resistance, and saturation magnetization of the resin-coated carrier (C-6) were 2.57 g/cm$^3$, $10^{13}$ Ωcm, and 76 emu/g, respectively.

Comparative Resin-Coated Carrier Preparation Example 2

Using a fluidized bed, the carrier prepared in Carrier Preparation Example 2 was coated with 5 wt.%, based on the carrier, of an epoxy resin-modified silicone resin (TSR-194, manufactured by Toshiba Silicone Co., Ltd.), which was then baked at 150° C. for 3 hours to prepare a resin-coated carrier (C-7).

The apparent density, resistance, and saturation magnetization of the resin-coated carrier (C-7) were 2.70 g/cm$^3$, $10^{14}$ Ωcm, and 48 emu/g, respectively.

Comparative Resin-Coated Carrier Preparation Example 3

Using a fluidized bed, the carrier prepared in Carrier Preparation Example 2 was coated with 2 wt.%, based on the carrier, of a styrene-methyl methacrylate resin prepared at a monomer composition ratio of styrene to methyl methacrylate of 45:55 to prepare a resin-coated carrier (C-8).

The apparent density, resistance and saturation magnetization of the resin-coated carrier (C-8) were 2.68 g/cm$^3$, $10^{13}$ Ωcm, and 48 emu/g, respectively.

Resin Preparation Example 1

Toluene was placed in a four-necked flask equipped with a stirrer, a reflux condenser, a thermometer and a nitrogen blow-in tube, heated to a temperature of 90° C., and stirred in an atmosphere of nitrogen while dropwise adding thereto a solution composed of 1,000 g of styrene monomer, 200 g of butyl acrylate and 30 g of azobisisobutyronitrile. The resulting mixture was stirred at 100° C. for hours, and then kept at 90° C. again while dropwise adding thereto a solution composed of 1,000 g of styrene monomer, 200 g of butyl acrylate and 6 g of azobisisobutyronitrile. The resulting mixture was stirred for 2 hours. The resulting reaction solution was gradually heated to distill off the toluene, further stripped of the toluene under reduced pressure, and allowed to cool spontaneously to prepare a transparent resin (R-1). The number-average molecular weight, molecular weight distribution width, softening point, and Tg of the obtained resin were about-10,000, 23, 135° C. as measured with the flow tester, and 65° C., respectively.

Resin Preparation Example 2

Ion-exchanged water and polyvinyl alcohol as a dispersant were placed in a four-necked flask equipped with a stirrer, a reflux condenser, a thermometer and a nitrogen blow-in tube, heated to a temperature of 70° C., and stirred while dropwise adding thereto a solution composed of 400 g of styrene monomer, 80 g of 2-ethylhexyl acrylate, 0.5 g of divinylbenzene and 9.5 g of azobisvaleronitrile. The resulting mixture was stirred at 70° C. for 5 hours, followed by cooling and filtration to give a bead-like transparent resin (R-2). The number-average molecular weight, molecular weight distribution width, softening point, and Tg of the resin were 8,300, 35, 130° C. as measured with the flow tester, and 63° C, respectively.

Resin Preparation Example 3

175 g of polyoxypropylene(2.0) bisphenol A, 162.5 g of polyoxyethylene(2.0) bisphenol A, 83 g of terephthalic acid, 38.4 g of trimellitic anhydride, and 53.6 g of dodecenylsuccinic anhydride were placed together with stannous oxide as a catalyst in a four-necked flask equipped with a stirrer, a reflux condenser, a thermometer and a nitrogen blow-in tube, heated to a temperature of 220° C., and stirred in an atmosphere of nitrogen to effect polycondensation thereof to prepare a light yellow resin (R-3) having a softening point of 130° C. as measured with the flow tester. The Tg of the resin was 65° C.

Resin Preparation Example 4

18.6 g of ethylene glycol, 53.2 g of propylene glycol, 165.1 g of dimethyl terephthalate, and 19.2 g of trimellitic anhydride were placed together with stannous oxide as a catalyst in a four-necked flask equipped with a stirrer, a reflux condenser, a thermometer and a nitrogen blow-in tube, heated to a temperature of 220° C, and stirred in an atmosphere of nitrogen to effect polycondensation thereof to prepare a light yellow resin (R-4) having a softening point of 145° C. as measured with the flow tester. The Tg of the resin was 67° C Resin Preparation Example 5

Toluene was placed in a four-necked flask equipped with a stirrer, a reflux condenser, a thermometer and a nitrogen blow-in tube, heated to a temperature of 90° C., and stirred in an atmosphere of nitrogen while dropwise adding thereto a solution composed of 1,000 g of styrene monomer, 200 g of butyl acrylate and 30 g of azobisisobutyronitrile. The resulting mixture was stirred at 100° C. for 2 hours, and then kept at 90° C. again while dropwise adding thereto a solution composed of 1,000 g of styrene monomer, 200 g of butyl acrylate and 6 g of azobisisobutyronitrile. The resulting mixture was stirred for 2 hours. The resulting reaction solution was gradually heated to distill off the toluene, further stripped of the toluene under reduced pressure, and allowed to cool spontaneously to prepare a transparent resin (R-5). The number-average molecular weight, molecular weight distribution width, softening point, and Tg of the obtained resin were about 8,000, 8, 130° C. as measured with the flow tester, and 65° C., respectively.

Resin Preparation Example 6

175 g of polyoxypropylene(2.0) bisphenol A, 162.5 g of polyoxyethylene(2.0) bisphenol A, 120.4 g of terephthalic acid, 9.6 g of trimellitic anhydride, and 53.6 g of dodecenylsuccinic anhydride were placed together with stannous oxide as a catalyst in a four-necked flask equipped with a stirrer, a reflux condenser, a thermometer and a nitrogen blow-in tube, heated to a temperature of 220° C., and stirred in an atmosphere of nitrogen to effect polycondensation thereof to prepare a light yellow resin (R-6) having a softening point of 130° C. as measured with the flow tester. The Tg of the resin was 65° C.

Resin Preparation Example 7

175 g of polyoxypropylene(2.0) bisphenol A, 162.5 g of polyoxyethylene(2.0) bisphenol A, 83 g of terephthalic acid, 38.4 g of trimellitic anhydride, and 53.6 g of dodecenylsuccinic anhydride were placed together with stannous oxide as a catalyst in a four-necked flask equipped with a stirrer, a reflux condenser, a thermometer and a nitrogen blow-in tube, heated to a temperature of 220° C., and stirred in an atmosphere of nitrogen to effect polycondensation thereof to prepare a light yellow resin (R-7) having a softening point of 110° C. as measured with the flow tester. The Tg of the resin was 63° C.

Example 1

100 parts by weight of the resin (R-1) prepared in Resin Preparation Example 1 was melt-kneaded together with 8 parts by weight of carbon black MA 8 (manufactured by Mitsubishi Chemical Industries, Ltd.) and 2.0 parts by weight of a charge control agent Bontron S 32 (manufactured by Orient Chemical Industries Ltd.), followed by pulverization and classification to prepare a toner having a mean particle size of 11 μm.

300 g of the toner was mixed with 10 kg of the resin-coated carrier (C-1) prepared in Resin-Coated Carrier Preparation Example 1 to prepare a developer.

2 kg of the obtained developer was placed in the developer container of a commercially available copying apparatus (using a selenium photosensitive member; 60 sheets/min), with which image formation, an endurance test and an environmental test were conducted. A fixability test was conducted using an external fixing apparatus.

Evaluation methods and judgement of performances were as follows.

(1) The amount of charge was measured by a blow-off method.

(2) The image density was measured with a Macbeth image densitometer. Other image qualities were visually evaluated.

(3) The environmental test was conducted under high-temperature and high-humidity conditions (35° C., 90% RH) as well as under low-temperature and low-humidity conditions (10° C., 15%.RH), and deterioration of an image was visually evaluated.

(4) An unfixed image was fixed using the external fixing apparatus at varied surface temperatures of the fixing roller thereof while visually examining the temperature of occurrence of offsetting. Cases where the hot offset temperature ranged between and 240 degree C. were marked with Δ, while cases where it was higher than 240° C. were marked with O. The lowest fixing temperature is defined as the temperature of the fixing roller at which the following rate of fixing exceeds 70% when a black solid portion is rubbed 5 times back and forth with a sand-containing eraser to which a load of 1 kg is applied. Cases where the lowest fixing temperature was at most 170° C. were marked with O, while cases where it exceeded 170° C. were marked with Δ.

$$\text{rate of fixing (\%)} = \frac{\text{(image density after rubbing)}}{\text{(image density before rubbing)}} \times 100$$

Results are shown in Table 1. Good fixing characteristics, offset latitude and fixability, were secured along with a good image density after the environmental test. In the endurance test, the amount of charge was substantially constant with a stable image density from the beginning of the test, while no image deterioration including scummings and tailings occurred until 200,000 sheets were printed.

Examples 2 to 15 and Comparative Examples 1 to 4

Toners and developers were prepared using carriers and resins listed in Table 1 in substantially the same manner as that of Example 1 to conduct image formation, an endurance test, an environmental test, and a fixing test. Results are shown in Table 1.

TABLE 1

| | | | | Evaluation results | | |
|---|---|---|---|---|---|---|
| Ex. No. and Comp. Ex. No. | Carrier No. | Resin No. | Amt. of charge (μc/g) initial/printing | Evaluation of image | Environmental stability | Offset latitude/ fixability |
| Ex. 1 | C-1 | R-1 | 18/17 (after 200,000 sheets) | The image density was stable at 1.45~1.35. No image deterioration including increasing background density and tailings. | O | O/O |
| Ex. 2 | C-1 | R-2 | 18/17 (after 200,000 sheets) | The image density was stable at 1.45~1.35. No image deterioration including increasing background density and tailings. | O | O/O |
| Ex. 3 | C-1 | R-3 | 20/18 (after 200,000 sheets) | The image density was stable at 1.45~1.35. No image deterioration including increasing background density and tailings. | O | O/O |
| Ex. 4 | C-1 | R-4 | 18/17 (after 200,000 sheets) | The image density was stable at 1.45~1.35. No image deterioration including increasing background density and tailings. | O | O/O |
| Ex. 5 | C-2 | R-1 | 20/18 (after 200,000 sheets) | The image density was stable at 1.40~1.30. No image deterioration including increasing background density and tailings. | O | O/O |
| Ex. 6 | C-2 | R-2 | 20/19 (after 200,000 sheets) | The image density was stable at 1.40~1.30. No image deterioration including increasing background density and tailings. | O | O/O |
| Ex. 7 | C-2 | R-3 | 23/20 (after 200,000 sheets) | The image density was stable at 1.40~1.30. No image deterioration including increasing background density and tailings. | O | O/O |
| Ex. 8 | C-2 | R-4 | 20/18 (after 200,000 sheets) | The image density was stable at 1.40~1.30. No image deterioration including increasing background density and tailings. | O | O/O |

TABLE 1-continued

| Ex. No. and Comp. Ex. No. | Carrier No. | Resin No. | Amt. of charge (μc/g) initial/printing | Evaluation results: Evaluation of image | Environmental stability | Offset latitude/ fixability |
|---|---|---|---|---|---|---|
| Ex. 9 | C-5 | R-2 | 18/17 (after 200,000 sheets) | The image density was stable at 1.45~1.35. No image deterioration including increasing background density and tailings. | O | O/O |
| Ex. 10 | C-5 | R-3 | 20/18 (after 200,000 sheets) | The image density was stable at 1.45~1.35. No image deterioration including increasing background density and tailings. | O | O/O |
| Ex. 11 | C-5 | R-4 | 20/18 (after 200,000 sheets) | The image density was stable at 1.40~1.30. No image deterioration including increasing background density and tailings. | O | O/O |
| Ex. 12 | C-3 | R-3 | 21/19 (after 100,000 sheets) | The image density was stable at 1.45~1.35. No image deterioration including increasing background dinsity and tailings. | O | O/O |
| Ex. 13 | C-1 | R-5 | 18/11 (after 100,000 sheets) | The amt. of charge tended to lower. The image density increased somewhat. | slightly increasing background dinsity under high-temp. and high-humidity conditions. | Δ/Δ |
| Ex. 14 | C-1 | R-6 | 20/18 (after 100,000 sheets) | Good image. | O | O/Δ |
| Ex. 15 | C-1 | R-7 | 18/10 (after 80,000 sheets) | The amt. of charge tended to lower. The image density increased somewhat. | slightly increasing background density under high-temp. and high-humidity conditions. | Δ/O |
| Comp. Ex. 1 | C-6 | R-2 | 18/9 (after 30,000 sheets) | The amt. of charge lowered. Image deteriorated. | Increasing background density under high-temp. and high-humidity conditions. | O/O |
| Comp. Ex. 2 | C-6 | R-3 | 20/10 (after 30,000 sheets) | The amt. of charge lowered. Image deteriorated. | Increasing background density under high-temp. and high-humidity conditions. | O/O |
| Comp. Ex. 3 | C-7 | R-3 | 21/10 (after 30,000 sheets) | The amt. of charge lowered. Image deteriorated. | Increasing background density under high-temp. and high-humidity conditions. | O/O |
| Comp. Ex. 4 | C-8 | R-3 | 22/9 (after 30,000 sheets) | The amt. of charge lowered. Image deteriorated. | Increasing background density under high-temp. and high-humidity conditions. | O/O |

We claim:

1. A developer for electrostatic images comprising a toner and a carrier, characterized in that said carrier is comprised of a magnetic powder having a composition represented by following formula (I), in which the surfaces of said powder is coated with a resin composition comprising a silicone resin in the form of a combination of segments represented by following general formula (II) and segments represented by following general formula (II') and at least one member selected from the group consisting of compounds represented by following general formula (III), (IV) or (V):

$$(MO)\times(Fe_5O_3)_y \qquad (I)$$

(wherein M stands for at least one metal selected from the group consisting of Li, Mg, Mn, Fe(II), Co, Ni, Cu, Zn, Cd, Sr, and Ba; and the molar ratio of x to y is at most 1.0);

$$\begin{array}{c} R \\ | \\ \leftarrow Si - O \rightarrow \\ | \\ R' \end{array} \qquad (II)$$

-continued

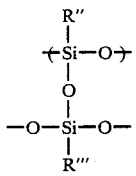

(II')

(wherein R, R', R'' and R''' each stand for a hydrogen atom, a halogen atom, a hydroxyl group, a methoxy group, a lower alkyl group having 1 to 4 carbon atoms, or a phenyl group);

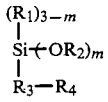

(III)

(wherein m is 2 or 3, $R_1$ and $R_2$ are each an alkyl group having 1 to 3 carbon atoms, $R_3$ is an alkylene group having 1 to 8 carbon atoms, and $R_4$ is a glycidoxy group or an epoxycyclohexyl group);

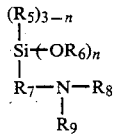

(IV)

( wherein n is 2 or 3; $R_5$ or $R_6$ are each an alkyl group having 1 to 3 carbon atoms; $R_7$ is an alkylene group having 1 to 3 carbon atoms; $R_8$ and $R_9$ are each a hydrocarbon atom, a methyl group, an ethyl group, a phenyl group, an aminomethyl group, or an aminoethyl group); and

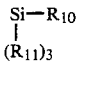

(V)

(wherein $R_{10}$ is an alkyl group having 1 to 3 carbon atoms or a vinyl group; and $R_{11}$ is a substituent selected from $R_{12}COO$—, $R_{12}$—NH—, [$R_{12}$—O—,]

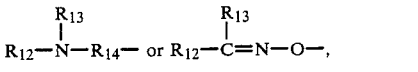

wherein $R_{12}$ and $R_{13}$ are each an alkyl group having 1 to 3 carbon atoms, and $R_{14}$ is an alkylene group having 1 to 3 carbon atoms.

2. The developer for electrostatic images as claimed in claim 1, wherein said toner comprises as the main component a binder resin composed of a polyester resin comprising as the main constituent units of a polybasic carboxylic acid, or an anhydride or an ester thereof represented by the following general formula (VI) and a diol represented by the following general formula (VII) and having a softening point of 120° to 180° C. as measured with a flow tester, and/or a styrene copolymer comprising as the main constituent units of styrene represented by following general formula (VIII) and an acrylic or methacrylic ester represented by following general formula (IX) and having a number-average molecular weight of at least 5,000, a width of molecular weight distribution of at least 10 and a softening point of at most 180° C. as measured with the flow tester:

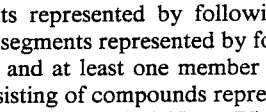

(VI)

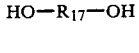

(VII)

(wherein L≧1, $R_{15}$ is a benzene ring, $R_{16}$ is a hydrogen atom or a lower alkyl group, and $R_{17}$ is a bivalent group containing a bisphenol group or an alkylene group having 2 to 6 carbon atoms; and wherein the acid component contains 0.06 to 0.60 mol % of a polybasic carboxylic acid(s) with L≧2); and

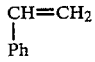

(VIII)

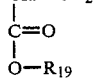

(IX)

(wherein Ph is a phenyl group, $R_{18}$ is a hydrogen atom or a methyl group, and $R_{19}$ is an alkyl group having 4 to 18 carbon atoms).

3. The developer for electrostatic images as claimed in claim 2, wherein the polybasic carboxylic acid, or an anhydride or an ester thereof is terephthalic acid or a lower alkyl ester thereof.

4. The developer for electrostatic images as claimed in claim 2, wherein the polybasic carboxylic acid, or an anhydride or an ester thereof is trimellitic acid, or an anhydride or a lower alkyl ester thereof.

5. An electrostatic image developer carrier comprising a magnetic powder having a composition represented by following formula (I), in which the surface of said powder is coated with a resin composition comprising a silicon resin in the form of a combination of segments represented by following general formula (II) and segments represented by following general formula (II') and at least one member selected from the group consisting of compounds represented by following general formula (III), (IV) or (V):

$$(MO)_x(Fe_2O_3)_y \quad (I)$$

(wherein M stands for at least one metal selected from the group consisting of Li, Mg, Mn, Fe(II), Co, Ni, Cu, Zn, Cd, Sr, and Ba; and the molar ratio of x to y is at most 1.0);

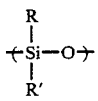

(II)

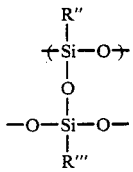

(II')

(wherein R, R′, R″ and R‴ each stand for a hydrogen atom, a halogen atom, a hydroxyl group, a methoxy group, a lower alkyl group having 1 to 4 carbon atoms, or a phenyl group);

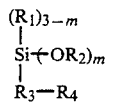

(III)

(wherein m is 2 or 3, $R_1$ and $R_2$ are each an alkyl group having 1 to 3 carbon atoms, $R_3$ is an alkylene group having 1 to 8 carbon atoms, and $R_4$ is a glycidoxy group or an epoxycyclohexyl group);

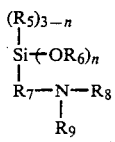

(IV)

(wherein n is 2 or 3; $R_5$ and $R_6$ are each an alkyl group having 1 to 3 carbon atoms; $R_7$ is an alkylene group having 1 to 3 carbon atoms; $R_8$ and $R_9$ are each a hydrogen atom, a methyl group, an ethyl group, a phenyl group, an aminomethyl group, or an aminoethyl group); and

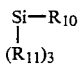

(V)

(wherein $R_{10}$ is an alkyl group having 1 to 3 carbon atoms or a vinyl group; and $R_{11}$ is a substituent selected from $R_{12}COO$—, $R_{12}$—NH—,

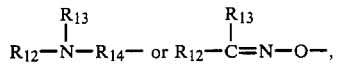

wherein $R_{12}$ and $R_{13}$ are each an alkyl group having 1 to 3 carbon atoms, and $R_{14}$ is an alkylene group having 1 to 3 carbon atoms).

6. The developer for electrostatic images as claimed in claim 1, wherein at least two members of said compounds are selected.

7. The developer for electrostatic images as claimed in claim 6, wherein the amount of said two members present is 0.1 to 7% by wt.

8. The developer for electrostatic images as claimed in claim 7, wherein the amount of said two members present is at least 5% by wt.

9. The developer for electrostatic images as claimed in claim 1, wherein said at least one member is the compound represented by general formula (III).

10. The developer for electrostatic images as claimed in claim 9, wherein the amount of said member present is 0.1 to 7% by wt.

11. The developer for electrostatic images as claimed in claim 10, wherein the amount of said member present is at least 5% by wt.

12. The developer for electrostatic images as claimed in claim 1, wherein said at least one member is the compound represented by general formula (IV).

13. The developer for electrostatic images as claimed in claim 12, wherein the amount of said member present is 0.1 to 7% by wt.

14. The developer for electrostatic images as claimed in claim 13, wherein the amount of said member present is at least 5% by wt.

15. The developer for electrostatic images as claimed in claim 1, wherein said at least one member is the compound represented by general formula (V).

16. The developer for electrostatic images as claimed in claim 15, wherein the amount of said member present is 0.1 to 7% by wt.

17. The developer for electrostatic images as claimed in claim 16, wherein the amount of said member present is at least 5% by wt.

* * * * *